United States Patent [19]

Balbinot

[11] 4,379,370

[45] Apr. 12, 1983

[54] DEVICE FOR ADJUSTING THE INCLINATION OF THE CUFF OR ANKLE COVERING PORTION OF A FOOTWEAR ARTICLE, IN PARTICULAR A SKI BOOT

[75] Inventor: Renzo Balbinot, Vittorio Veneto, Italy

[73] Assignee: Nordica S.p.A., Montebelluna, Italy

[21] Appl. No.: 260,154

[22] Filed: May 4, 1981

[30] Foreign Application Priority Data

May 23, 1980 [IT] Italy ..... 21894/80[U]

[51] Int. Cl.[3] ..... A43B 5/04

[52] U.S. Cl. ..... 36/121

[58] Field of Search ..... 36/121

[56] References Cited

U.S. PATENT DOCUMENTS 3,543,421 12/1970 Ader ..... 36/121

4,138,828 2/1979 Kubelka ..... 36/121

FOREIGN PATENT DOCUMENTS 2807371 8/1979 Fed. Rep. of Germany ..... 36/121

*Primary Examiner*—Patrick D. Lawson

*Attorney, Agent, or Firm*—Guido Modiano; Albert Josif

[57] ABSTRACT

A device for adjusting the inclination of a ski boot cuff comprises an abutment block effective to be engaged at different heights on the rear portion of the ski boot shell to contact the cuff such as to vary, in the rest condition, the inclination between the longitudinal centerline of the skier's leg wherewith the cuff is associated and the longitudinal centerline of the shell.

3 Claims, 4 Drawing Figures

DEVICE FOR ADJUSTING THE INCLINATION OF THE CUFF OR ANKLE COVERING PORTION OF A FOOTWEAR ARTICLE, IN PARTICULAR A SKI BOOT

BACKGROUND OF THE INVENTION

This invention relates to a device for adjusting the inclination of the cuff or ankle covering portion of a footwear article, in particular a ski boot.

As is known, a ski boot generally comprises a shell, wherewith a cuff member is associated which is intended in practice to enclose the lower portion of a skier's leg and is mounted such as to provide, in the rest condition, a preset inclination or angle between the skier's lower leg portion and the longitudinal centerline of the shell. The cuff is generally hinged to the shell for pivotal movement about a substantially horizontal axis which extends perpendicular to the shell length, such as to afford a pivotal forward movement, however limited, while skiing.

However, conventional devices provide an inclination in the rest condition, which is actually dictated by the cuff and not always suits one's skiing habits or the type of track being used, so that problems may be encountered with the skier's attitude or trim.

SUMMARY OF THE INVENTION

This invention sets out to eliminate such prior art drawbacks by providing a device for adjusting the cuff inclination angle, particularly on ski boots, which affords, through extremely simple and readily operable means, the possibility of changing within limits the angle formed, in the rest condition, by the centerline of the lower portion of the skier's leg with the longitudinal centerline of the shell, such as to meet a variety of contingent requirements.

Within the above general aim, it is possible to arrange that the device of this invention causes no inconvenience to the skier and creates no obstructions on the ski boot itself.

It is further possible to arrange that the device of this invention, by virtue of its extremely simple construction, is quite reliable and safe to use.

It is further possible to arrange that the device according to the invention can be easily manufactured from elements and materials which are readily available on the market, and is highly competitive from a purely economical standpoint.

According to one aspect of the present invention, there is provided a device for adjusting the inclination of a cuff, particularly on a ski boot, comprising an abutment block associated with the rear portion of the shell of a ski boot and being adapted to engage in contact relationship the cuff such as to determine the inclination, in the rest condition, between the longitudinal centerline of the skier's leg wherewith said cuff is associated and the longitudinal centerline of said shell, characterized in that said abutment block can be positioned at different height levels on said shell, thereby said inclination can be changed.

BRIEF DESCRIPTION OF THE DRAWINGS

Further features and advantages of the invention will be more readily understood from the following detailed description of a device for adjusting the inclination of the cuff, particularly in a ski boot, with reference to the accompanying exemplary drawings, where.

DESCRIPTION OF THE PREFERRED EMBODIMENTS

Figure 2:
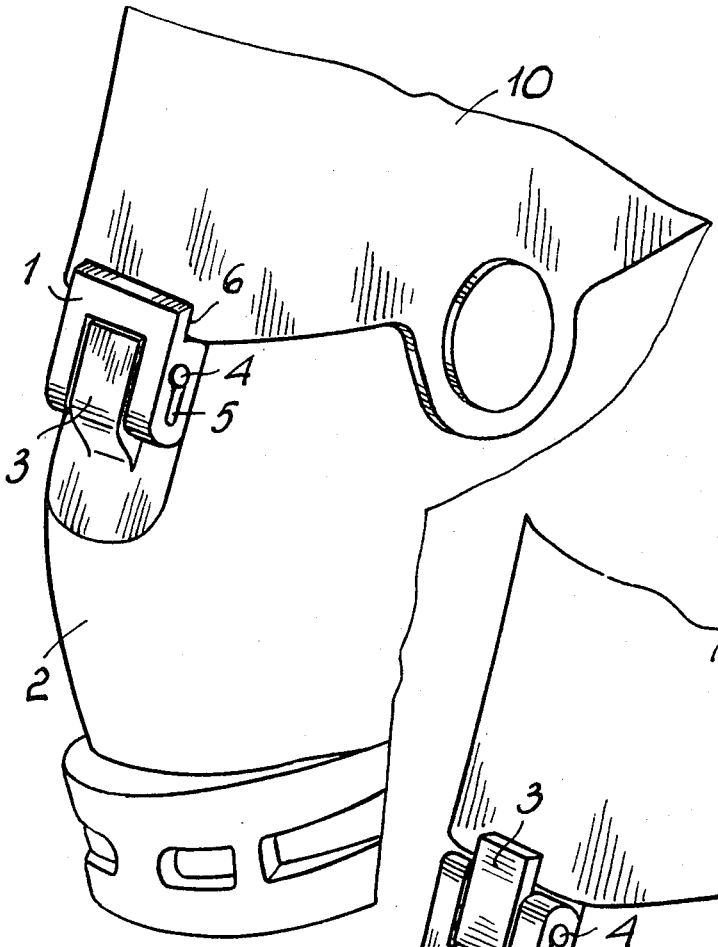
FIG. 2 shows the same device according to the invention with the block in its raised position.
Figure 1:
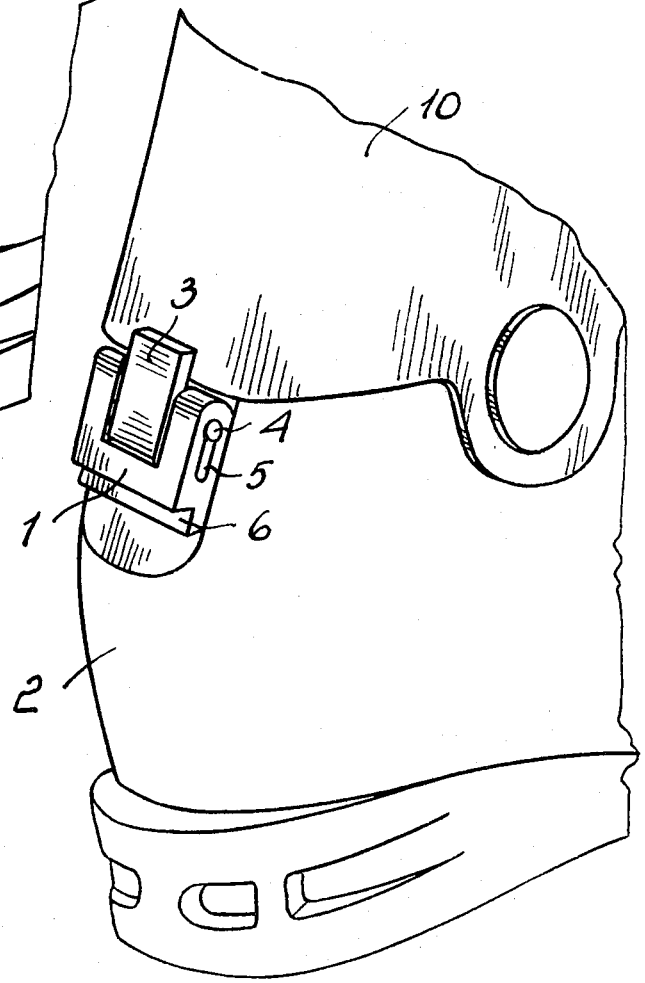
FIG. 1 shows the device according to the invention with the block in its lowered position.

With reference to the drawing figures, and more particularly to FIGS. 1 and 2 thereof, there is illustrated a device for adjusting the inclination of the cuff member of a boot, which comprises a flattened abutment block 1 located at the rear portion of the shell 2 of a ski boot.

Said block 1 is preferably configured as a yoke member set astride a protrusion 3 from the rear portion of the shell 2.

The block 1 is hingedly connected to the protrusion 3 by means of a pivot pin 4 projecting outwardly on either sides of the protrusion 3 and engaging in an elongated slot 5 defined in the block 1.

The device illustrated enables two different inclinations to be preset, in the rest condition, of the longitudinal centerline of the leg lower portion to the shell longitudinal centerline; more specifically, it is possible to obtain a reduced inclination (FIG. 1) in the instance where the cuff, as indicated at 10, engages the protrusion 3 in contact relationship therewith, and in this position the block 1 will be tilted down.

To increase the inclination of the cuff, i.e. in actual practice to reduce the angle formed between the centerline of the leg lower portion and the longitudinal centerline of the shell, the block 1 can be tilted up and then caused to slide relatively to the pivot pins 4, thereby it is brought to a locking position wherein it is located above the protrusion 3. It should be also noted that the block is formed, at the edge thereof, with a notch 6 wherein the edge of the cuff 10 is engageable such as to change its inclination, since said notch 6, with the block in the second position shown in FIG. 2, is located at a higher level than the protrusion 3.

Obviously, in order to restore the initial or starting condition, it will be sufficient to pull the block 1 upwards such as to cause the pivot pin 4 to slide in the slot 5, and then turn the block 3 downwards, thereby the condition shown in FIG. 1 is restored.

Figure 3:
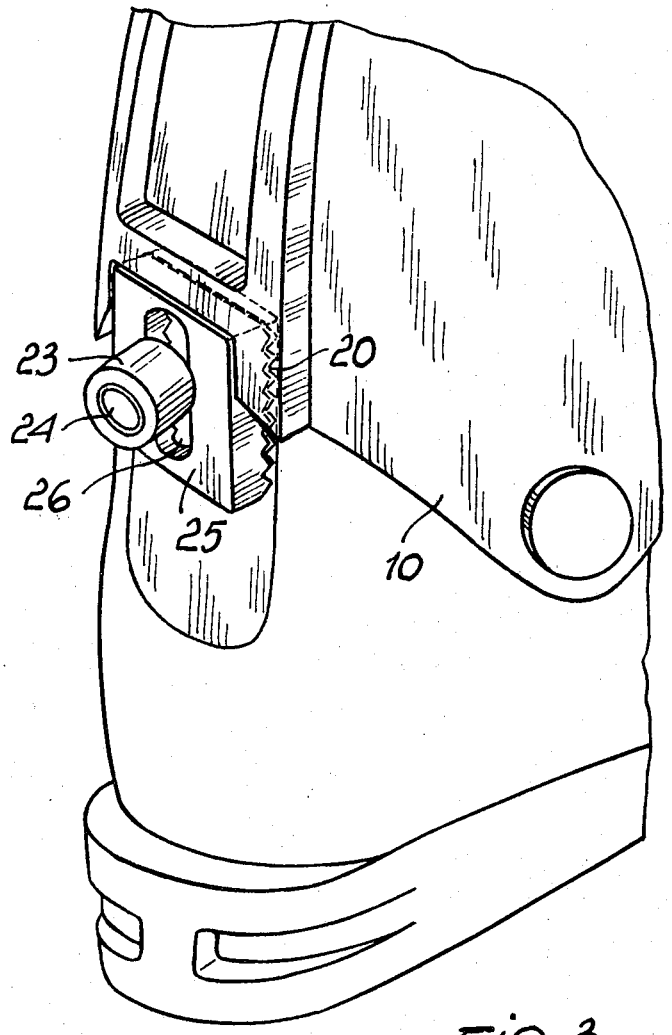
FIG. 3 is a perspective view, from the rear, of another device for continuously adjusting the cuff inclination, according to this invention.
Figure 4:
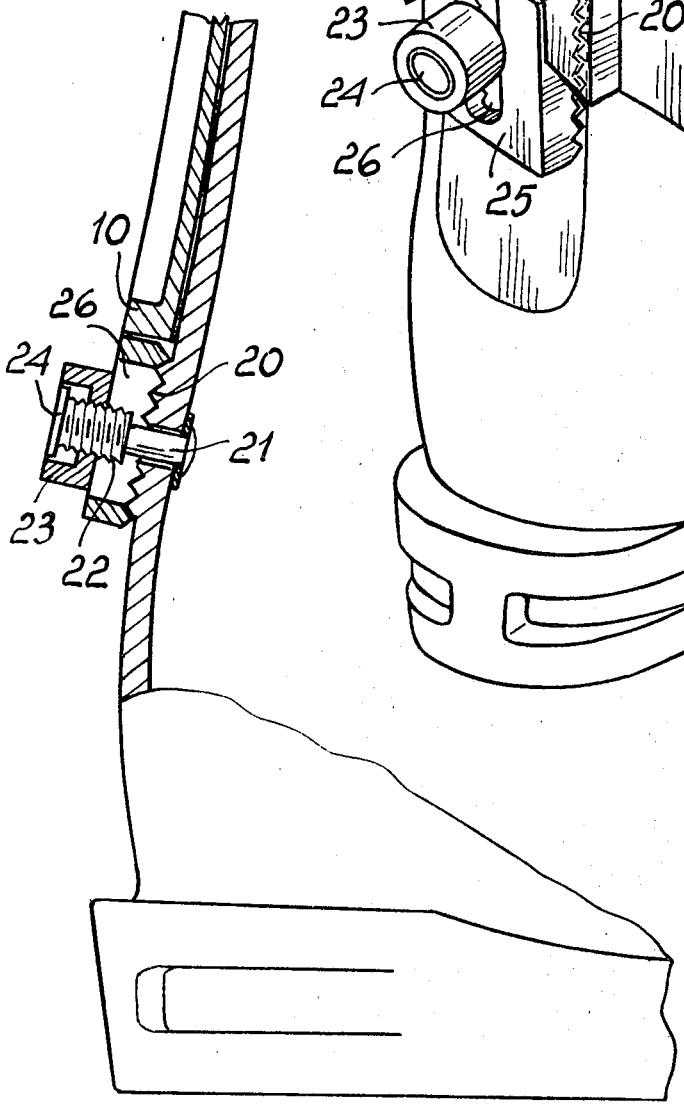
FIG. 4 is a sectional view of the device of FIG. 3.

FIGS. 3 and 4 illustrate another device according to the invention, whereby the inclination can be adjusted on a continuous basis. This device comprises, located on the rear portion of the shell 2, a serrated protrusion 20, whereat a throughgoing pivot pin 21 is provided which is inserted in the shell 2 and upset in place during the assembly stage. The pin 21 has on its outward portion a threaded region 22 whereon there engages a ring nut 23 which is installed before the pin 21 is fastened to the shell 2, thereby the ring nut cannot slide off in use, owing to the presence of an enlarged head 24 at the end of the threaded region 22.

The ring nut 23 is effective to act on a abutment block 25 which has a serration thereon and a longitudinal throughgoing slot 26, wherethrough the pin 21 is allowed to slide such as to enable the serrated block 25 to be positioned at various height levels in selecting its correct position.

With the upper or top edge of the block 25, there interacts in abutment relationship a section of the cuff 10 such that the inclination, in the rest condition, of the cuff 10 is in practice determined by the preset position of the block 25.

Of course, to change the inclination, it will be sufficient to loosen the ring nut 23 and shift the block 25 up or down until the position is reached which corresponds to the desired inclination angle, and then newly tighten the ring nut 23.

It should be added to the foregoing, for completeness' sake, that the protrusions 3 and 21 can be formed directly on the shell 2, or made of a different material and assembled thereto. Similarly, the blocks 1 and 25 may be formed from a plastic material or any other suitable material.

It will be appreciated from the foregoing description that the invention does achieve its objects, and in particular that, through the utilization of extremely simple and quickly operated means, one is enabled to change within ample limits the inclination imparted to the cuff in the rest condition with respect to the shell, such as to meet without difficulty varying contingent requirements of the user.

In practicing the invention, the materials used, as well as the dimensions and shapes, may be any ones, depending on individual situations.

I claim:

1. A device for adjusting inclination of a cuff, particularly on a ski boot, comprising an abutment block for engagement with a shell of the boot, said abutment block having an abutment surface for said cuff such as to determine the inclination between said cuff and said shell in a rest position of said cuff, and further comprising a serrated protrusion on said shell, a serration on said abutment block for cooperation with said serrated protrusion, a longitudinal throughgoing slot in said abutment block, a pin projecting outwardly from said shell at the region of said serrated protrusion and extending through said longitudinal slot, a threaded region on said pin, and a tightening ring nut for cooperation with said threaded region for tightening said abutment block against said shell at selected different height levels.

2. A device as claimed in claim 1, wherein said pin has, at the end of said threaded region, an enlarged head for preventing said tightening ring nut from accidentally sliding off said pin.

3. A device as claimed in claim 1, wherein said pin is associated with said shell by upsetting.

* * * * *